US009527290B2

(12) United States Patent
Yoshinari et al.

(10) Patent No.: US 9,527,290 B2
(45) Date of Patent: Dec. 27, 2016

(54) METHOD OF CLEANING LIQUID DISCHARGE HEAD

(71) Applicant: CANON KABUSHIKI KAISHA, Tokyo (JP)

(72) Inventors: Norihiro Yoshinari, Kawasaki (JP); Yuzuru Ishida, Yokohama (JP); Maki Kato, Fuchu (JP); Yoshinori Misumi, Tokyo (JP); Akio Goto, Tokyo (JP); Takahiro Matsui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/789,711

(22) Filed: Jul. 1, 2015

(65) Prior Publication Data

US 2016/0001560 A1 Jan. 7, 2016

(30) Foreign Application Priority Data

Jul. 4, 2014 (JP) ..... 2014-138879
Apr. 9, 2015 (JP) ..... 2015-080456

(51) Int. Cl.
*B41J 2/14* (2006.01)
*B41J 2/165* (2006.01)

(52) U.S. Cl.
CPC ..... *B41J 2/16517* (2013.01); *B41J 2/1404* (2013.01); *B41J 2/14016* (2013.01); *B41J 2/14032* (2013.01); *B41J 2/14072* (2013.01); *B41J 2/14088* (2013.01); *B41J 2002/14403* (2013.01); *B41J 2002/16561* (2013.01); *B41J 2202/08* (2013.01)

(58) Field of Classification Search
CPC . B41J 2/14016; B41J 2/14032; B41J 2/14072; B41J 2/14096; B41J 2202/08
See application file for complete search history.

(56) References Cited

U.S. PATENT DOCUMENTS

2007/0146428 A1* 6/2007 Sakai ..... B41J 2/14072 347/50

FOREIGN PATENT DOCUMENTS

JP 2008-105364 A 5/2008

* cited by examiner

*Primary Examiner* — Kristal Feggins
*Assistant Examiner* — Kendrick Liu
(74) *Attorney, Agent, or Firm* — Canon USA, Inc. IP Division

(57) ABSTRACT

A method of cleaning a liquid discharge head having a substrate provided with a supply port, a heat-generating resistor covered with a covering layer, a liquid chamber forming member configured to form a liquid chamber, and at least one electrode and being configured to discharge liquid supplied to the liquid chamber from the supply port by causing the heat-generating resistor to generate heat, includes applying a voltage to the covering layer and the electrode to cause an electrochemical reaction between the covering layer and the liquid and dissolve the covering layer into the liquid to remove kogations accumulated on the covering layer, in which the covering layer and the electrode to which the voltage is to be applied are not provided in the same liquid chamber having the same cross-sectional area in a direction from the covering layer toward the electrode.

14 Claims, 7 Drawing Sheets

METHOD OF CLEANING LIQUID DISCHARGE HEAD

BACKGROUND OF THE INVENTION

Field of the Invention

This disclosure relates to a method of cleaning a liquid discharge head.

Description of the Related Art

Examples of known liquid discharge heads to be used in an inkjet printer or the like include a liquid discharge head of a type which discharges liquid by using a heat-generating resistor. The liquid discharge head of this type includes a channel forming member that forms a flow channel of liquid such as ink and a heat-generating resistor. The heat-generating resistor is formed of an electric thermal conversion element or the like, and is configured to heat liquid rapidly at a contact portion (heat application portion) with liquid located above the heat-generating resistor by generating heat, thereby causing the liquid to foam. By a pressure in association with this foaming, the liquid is discharged from a discharge port, whereby recording on a surface of a recording medium such as paper is achieved. A configuration of the heat-generating resistor covered with an insulation layer for insulating the heat-generating resistor from liquid is known. The heat-generating resistor multiply receives a physical action such as an impact caused by cavitation in association with foaming and contraction of liquid and a chemical action of liquid. Therefore, a configuration in which the heat-generating resistor is covered with a protective layer to protect the heat-generating resistor is known.

In the liquid discharge head, an additive such as color materials contained in liquid is decomposed by being heated at a high temperature, and is changed to a substance with low solubility, so that a phenomenon of being physically adsorbed onto a layer such as the insulation layer or the protective layer which is in contact with liquid may occur. This phenomenon is called a "kogation". If kogation is adhered onto the protective layer, thermal transfer from a heat application portion to liquid becomes uneven and, consequently, foaming becomes unstable, whereby a liquid discharging property may be affected.

In order to solve the above-described problem, Japanese Patent Laid-Open No. 2008-105364 describes a configuration in which the upper protective layer is arranged in an area including the heat application portion so that it can be electrically connected to serve as an electrode which causes an electrochemical reaction with the liquid and, in addition, a counter electrode is arranged in the same liquid chamber. According to the configuration described in Japanese Patent Laid-Open No. 2008-105364, the upper protective layer serves as an anode electrode and the counter electrode serves as a cathode electrode, so that the upper protective layer is dissolved by the electrochemical reaction, whereby kogation on the heat application portion can be removed.

SUMMARY OF THE INVENTION

This disclosure provides a method of cleaning a liquid discharge head having a substrate provided with a supply port, a heat-generating resistor covered with a covering layer, a liquid chamber forming member configured to form a liquid chamber, and at least one electrode, and being configured to discharge liquid supplied to the liquid chamber from the supply port by causing the heat-generating resistor to generate heat, the method including: applying a voltage to the covering layer and the electrode to cause an electrochemical reaction between the covering layer and the liquid and dissolve the covering layer into the liquid to remove kogation accumulated on the covering layer, wherein the covering layer and the electrode to which the voltage is to be applied are not provided in the same liquid chamber having the same cross-sectional area in a direction from the covering layer toward the electrode.

Further features of the present invention will become apparent from the following description of exemplary embodiments with reference to the attached drawings.

DESCRIPTION OF THE EMBODIMENTS

Figure 1:
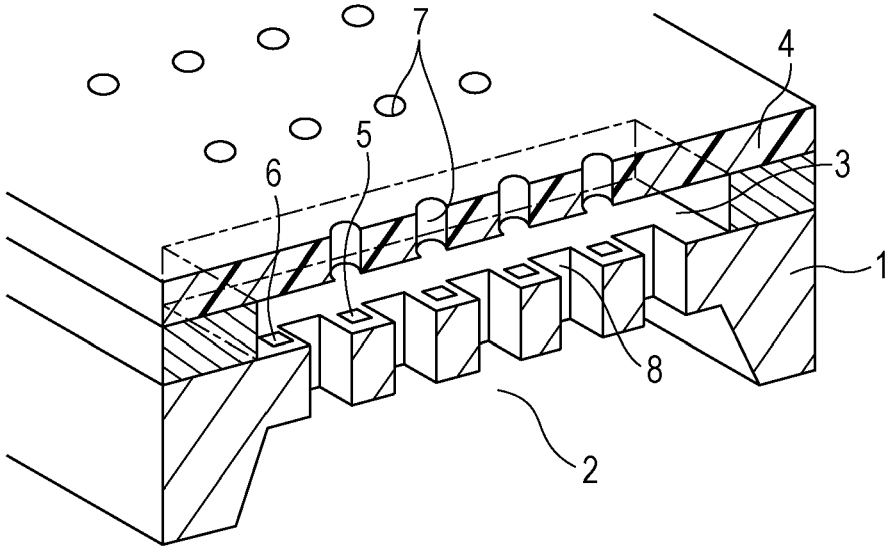
FIG. 1 is a drawing illustrating a liquid discharge head.

According to the study and researches of the present inventors, with a method disclosed in Japanese Patent Laid-Open No. 2008-105364, kogation on the heat application portion can be removed. However, since the upper protective layer and the counter electrode are located in the same liquid chamber, the degree of dissolution of the upper protective layer tends to vary in the upper protective layer. Specifically, an area of the upper protective layer closer to the counter electrode is dissolved quickly, and an area farther from the counter electrode is dissolved late. Therefore, a difference in thickness of the upper protective layer may become apparent. Consequently, there is the case where stability of discharge of liquid may be lowered.

This disclosure provides a method of cleaning a liquid discharge head in which variations in degree of dissolution in a layer are suppressed even when kogation is removed by dissolution of the layer on the basis of an electrochemical reaction.

Hereinafter, embodiments of this disclosure will be described with reference to the drawings. A liquid discharge head illustrated in FIG. 1 includes a substrate 1 provided with a supply port 2, and a liquid chamber forming member 4 provided with a liquid chamber 3. Furthermore, the liquid chamber 3 contains liquid inside thereof, and is provided with a covering layer 5 and an electrode 6. A discharge port 7 is provided with the liquid chamber forming member 4. The covering layer 5 covers a heat-generating resistor, and this part corresponds to a heat application portion. The discharge port 7 is formed at a position opposing the heat application portion. Independent supply ports 8 which are independent from each other extend from a ceiling portion of the supply port 2 formed on the substrate 1. Liquid passes from the supply port 2 of the substrate 1 through the independent supply port 8 and is supplied to the liquid chamber 3. The liquid receives energy from the heated heat-generating resistor, is discharged from the discharge port 7, and is landed on a recording medium such as paper. In this manner, images and the like are recorded on the recording medium. The liquid discharge head described thus far is provided in a liquid discharge apparatus such as an inkjet printer.

This disclosure is made to suppress variations in degree of dissolution of the covering layer 5 when applying a voltage to the covering layer 5 and the electrode 6 to remove kogation. Although detailed description will be given in conjunction with respective embodiments, the present inventors have found that the variations in dissolution of the covering layer 5 can be suppressed by increasing resistance between the covering layer 5 and the electrode 6. The embodiments of this disclosure will be described below.

First Embodiment

Figure 2A:
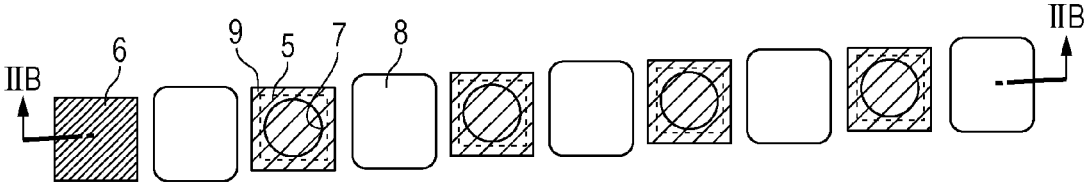
FIGS. 2A to 2C are drawings illustrating the liquid discharge head and a cleaning method for removing kogation.

FIG. 2A is a drawing illustrating a portion of a row of the covering layers 5 (row of heat application portions) illustrated in FIG. 1 viewed from a position opposing a surface (front surface) where the independent supply ports 8 of the substrate 1 are opened. In FIG. 2A, the electrode (counter electrode) 6 is arranged at an end of the row and then the independent supply ports 8 and heat-generating resistors 9 are arranged alternately. In the row illustrated in FIG. 2A, the liquid chamber is not sectionalized. However, the liquid chamber may be sectionalized into a plurality of liquid chambers corresponding to respective sets divided so that each set includes the independent supply port 8 and the heat-generating resistor 9, for example along the row.

Figure 2B:
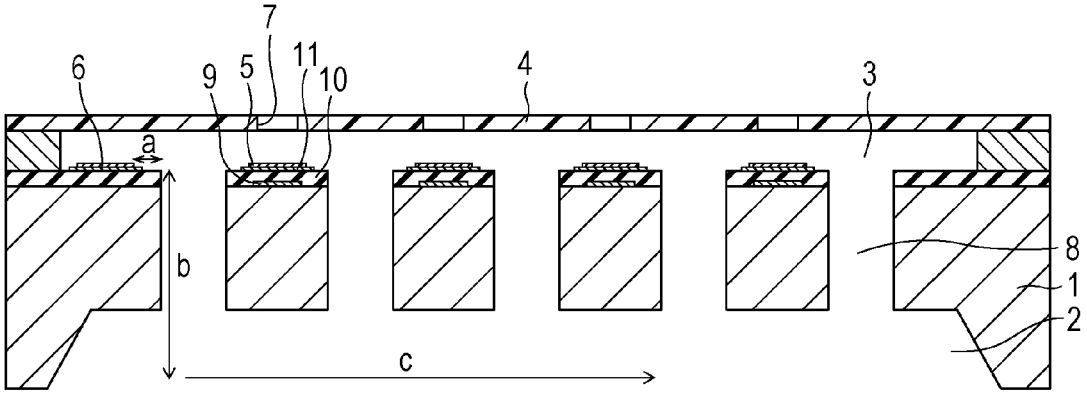
Figure 2C:
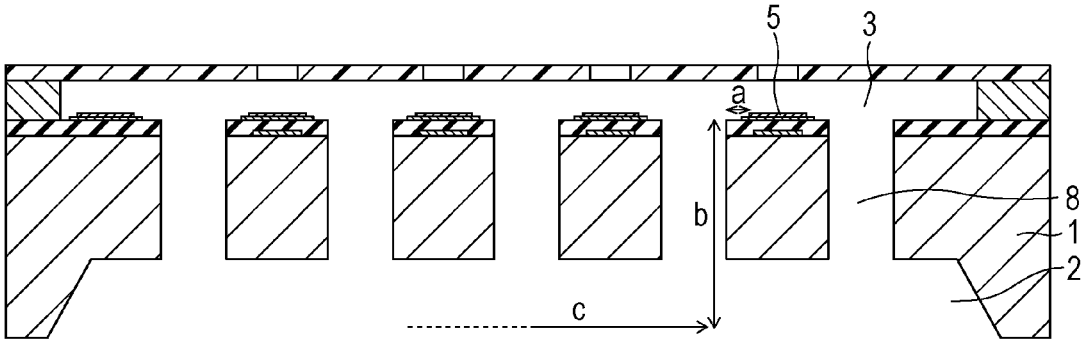

A cross section of the liquid discharge head taken along the line IIB-IIB in FIG. 2A is illustrated in FIG. 2B. FIG. 2C illustrates a cross section of the liquid discharge head in a row next to the row illustrated in FIG. 2B and having a similar configuration. The substrate 1 is formed, for example, of silicon. An upper part of the substrate 1 may be provided with a film of, for example, $SiO_2$ or SiN. The heat-generating resistor 9 formed of TaSiN or the like is formed on the surface of the substrate 1. The heat-generating resistor 9 is covered with an insulation layer 10 formed of SiN or the like, and is provided with an adhesion layer 11 formed thereon and is further covered with the covering layer 5. The insulation layer 10 and the adhesion layer 11 do not necessarily have to be provided, and the covering layer 5 may directly cover the heat-generating resistor 9. The covering layer 5 does not have to cover the entire portion of the heat-generating resistor 9, but at least an upper surface (surface corresponding to the discharge port) of the heat-generating resistor 9 can be covered. The covering layer 5 can be a multilayer including stacked layers. The adhesion layer 11 is formed of, for example, Ta. The adhesion layer 11 is inserted in a through hole formed in the insulation layer 10, and is connected to an electrode wiring layer formed of a metallic material such as Al, Al—Si, and Al—Cu, which are not illustrated. A distal end of the electrode wiring layer is electrically connected to an external terminal, and hence serves as an external electrode, which is not illustrated. Accordingly, the covering layer 5 and the external terminal are electrically connected. The electrode wiring layer is connected also to the heat-generating resistor 9, whereby electricity is supplied to the heat-generating resistor 9 to generate heat.

Subsequently, a method of performing a cleaning process for removing kogation will be described. The cleaning process for removing kogation includes applying a voltage between the covering layer 5 as an anode electrode, and the electrode 6 as a cathode electrode and causing an electrochemical reaction between liquid, which is a solution including an electrolyte, and the covering layer 5. Since the covering layer 5 is connected to the external electrode via the electrode wiring layer, the voltage may be applied so that the covering layer 5 become an anode side. A surface portion (in the case of a multilayer, the uppermost layer) of the covering layer 5, which is the anode electrode, is dissolved and kogations accumulated on the covering layer 5 are removed. A metallic material dissolved into liquid by the electrochemical reaction may generally be figured out by referring to a potential −pH chart of various metals. The material used as the covering layer 5 can be a material having a property that is not dissolved at a pH value of the liquid, but is dissolved when the covering layer 5 becoming the anode electrode by application of a voltage. In other words, a metal which is dissolved by the electrochemical reaction in the liquid can be used as the covering layer 5. Examples of such metals include Ir and Ru. The electrode 6, being the counter electrode, can also be formed of a material having a property that is not dissolved at a pH value of the liquid, but is dissolved when the covering layer 5 becoming the anode electrode by application of a voltage. For example, Ir and Ru are exemplified. In addition, the electrode 6 can be formed of the same material as the covering layer 5. By dissolving the covering layer 5, kogations accumulated thereon can be dissolved together.

The uppermost surface (liquid side surface) of the covering layer 5 can be made of Ir. This is because the uppermost layer of the electrode 6, which is the cathode electrode, formed of Ir suppresses oxidation of the upper layer during discharge of the liquid, and can maintain the stability of the cathode electrode. The electrode 6 connected to a cathode side does not necessarily have to have a multilayer structure. However, when considering manufacturing processes such as film formation and etching processes, the same layer structure as that of the covering layer 5 can be employed.

Figure 3:
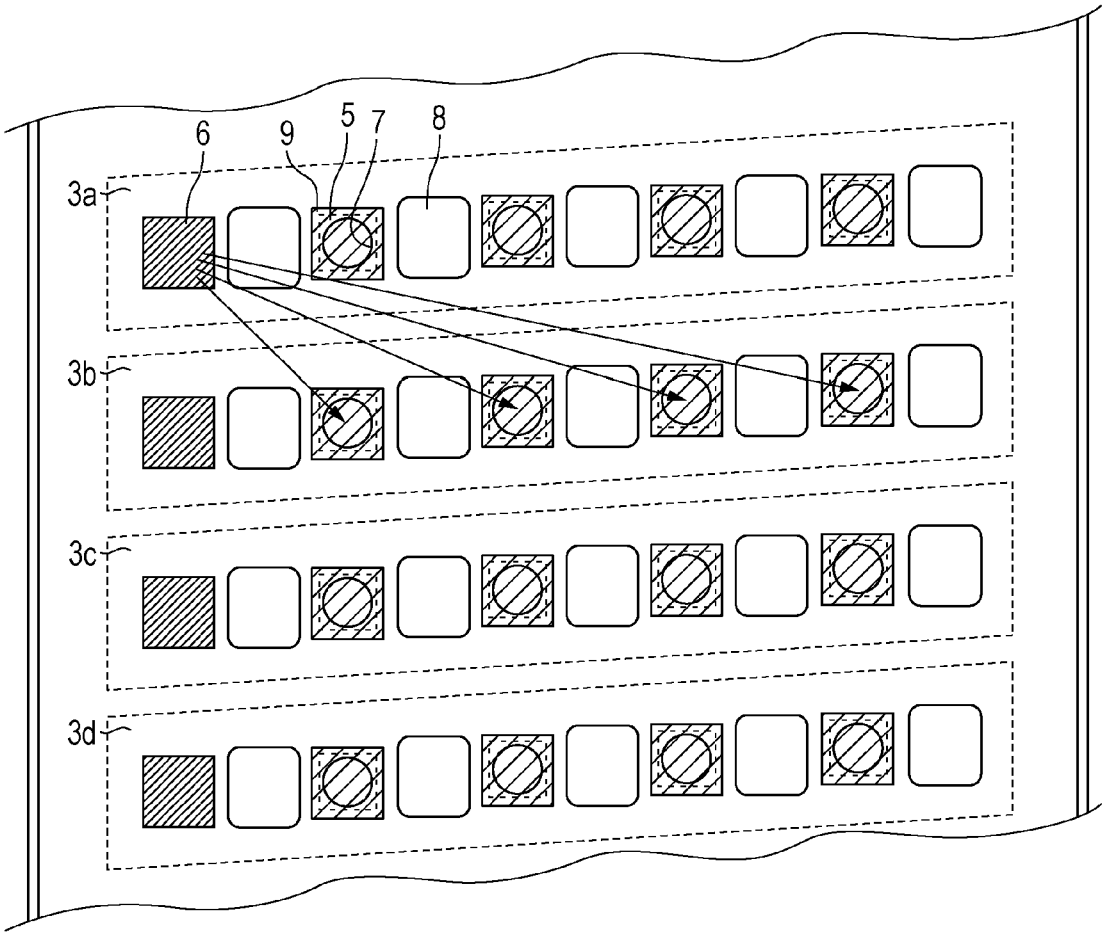
FIG. 3 is a drawing illustrating the cleaning method for removing kogation from the liquid discharge head.

Here, characteristic points of the method of cleaning the liquid discharge head of the first embodiment will be described. The row next to the row of the heat-generating resistors 9 illustrated in FIG. 2B is illustrated in FIG. 2C. FIG. 3 illustrates the liquid chamber 3 in FIG. 2B as a liquid chamber 3*a* and the liquid chamber 3 in FIG. 2C as a liquid chamber 3*b*, together with a liquid chamber 3*c* and a liquid chamber 3*d*. The respective liquid chambers are sectionalized by a liquid chamber forming member. In this disclosure, removal of kogations is performed by applying a voltage between the covering layer 5 and the electrode 6 and causing an electrochemical reaction between the covering layer 5 and the liquid. The covering layer 5 and the electrode 6 to which the voltage is to be applied are arranged in the different liquid chambers, and are not provided in the same liquid chamber, and communicate with each other with liquid via the supply port 2 formed on the substrate 1. Description will be given with reference to FIG. 2B and FIG. 2C. For example, a voltage is applied between the electrode 6 in FIG. 2B and the covering layer 5 in FIG. 2C. The electrode 6 and the covering layer 5 communicate with each other with the liquid via a route indicated by symbols a, b, c, b, and a. The supply port 2 filled with the liquid is interposed therebetween. With reference to FIG. 3, a voltage is applied between the electrode 6 in the liquid chamber 3*a* in FIG. 3 and the covering layer 5 of the liquid chamber 3*b*. In this disclosure, since the application of the voltage is performed via the supply port in this manner, a long distance can be secured between the covering layer 5 and the electrode 6. Consequently, a difference in degree of dissolution of the covering layer in the covering layer 5 can be suppressed. Although an increase in the distance between the covering layer 5 and the electrode 6 in the same liquid chamber is limited because of the size and layout of the liquid chamber, the method of increasing the distance therebetween via the supply port is not much subject to the design constraints. During the voltage being applied in this manner, the voltage is not applied to the covering layer 5 in the liquid chamber where the electrode 6 to which the voltage is to be applied exists. In FIGS. 2A to 2C, no voltage is applied to the covering layer 5 in FIG. 2B. In addition, no voltage is applied to the covering layer 5 which is not subject to the removal of kogations.

Figure 4A:
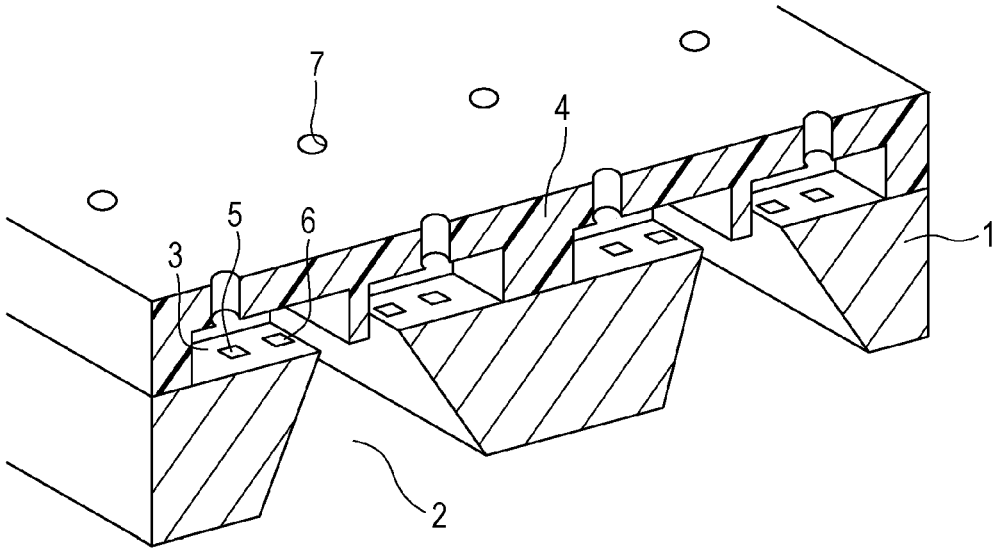
FIGS. 4A and 4B are drawings illustrating the liquid discharge head and the cleaning method for removing kogation.
Figure 4B:
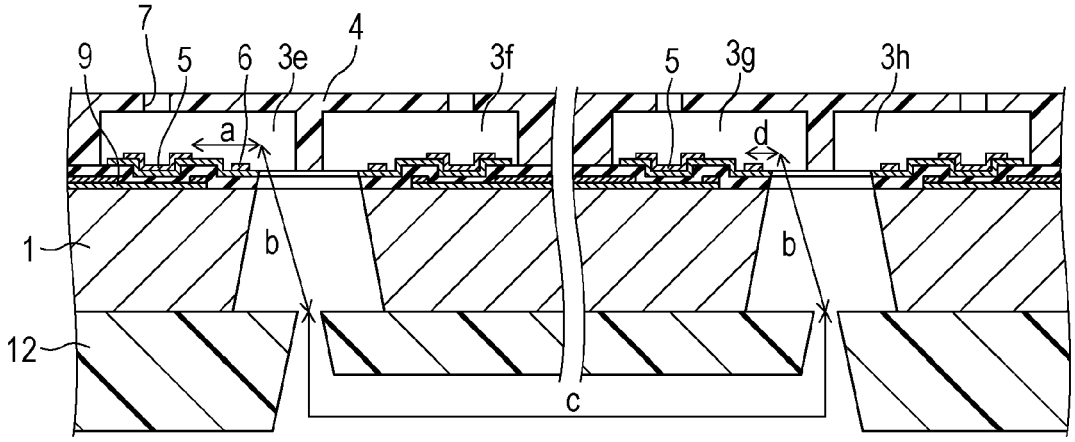

As illustrated in FIG. 4A, the liquid discharge head of this disclosure may have the supply port 2 provided between two of the liquid chambers instead of having the independent supply port 8 in FIG. 1. In this case, the liquid supplied from the supply port 2 is separated and supplied to the two liquid chambers 3. FIG. 4B illustrates a cleaning process for removing kogation on the liquid discharge head by using the liquid discharge head as described above. FIG. 4B illustrates four liquid chambers 3*e*, 3*f*, 3*g*, and 3*h* as the liquid chambers 3. A voltage is applied between the covering layer 5 in the liquid chamber 3*e* and the electrode 6 in the liquid chamber 3*g* to dissolve the covering layer 5 in the liquid chamber 3*e*. The covering layer 5 in the liquid chamber 3*e* and the electrode 6 in the liquid chamber 3*g* communicate with each other with the liquid by a route indicated by symbols a, b, c, b, and d. The supply ports exist therebetween. In addition, in FIG. 4B, a supporting member 12 configured to support the substrate 1 is provided below the substrate 1. The supporting member 12 is formed of a resin, alumina, or the like. In FIG. 4B, since the covering layer 5 and the electrode 6 communicate with each other also via the liquid in the flow channel in the supporting member 12, the distance therebetween may further be increased, and occurrence of variations in thickness of the covering layer 5 due to the removal of kogation can be desirably suppressed. Although the example in which the kogation is removed by applying a voltage between the liquid chamber 3*e* and the liquid chamber 3*g* has been described, a voltage may be applied between the liquid chamber 3*e* and the liquid chamber 3*h*. In this case, the liquid chamber 3*e* and the liquid chamber 3*h* communicate with each other via supply ports below the liquid chamber 3*e* and the liquid chamber 3*h*.

The distance between the covering layer and the electrode to which a voltage is to be applied at the time of cleaning process for removing kogation can be at least 60 μm. With the distance of at least 60 μm, the thickness of the covering layer can be reduced uniformly. The distance is preferably at least 90 μm, more preferably at least 150 μm, and further preferably at least 250 μm. If the distance between the covering layer and the electrode is too long, it takes time to remove the kogation. From this point, the distance between the covering layer and the electrode to which a voltage is to be applied at the time of cleaning process for removing kogation can be not more than 6000 μm. The distance is preferably not more than 3000 μm, and more preferably not more than 2000 μm. The distance here means a minimum distance via the liquid.

The electrode 6 does not necessarily have to be provided in the same liquid chamber as the heat-generating resistor 9 and the covering layer 5. For example, a configuration is also applicable in which a dummy liquid chamber that is not provided with the heat-generating resistor 9 and the covering layer 5 is provided at an end of the row of the heat-generating resistors (or row of discharge ports) and the electrode 6 is arranged in the dummy liquid chamber.

When performing the cleaning process for removing kogation, removal of kogation can be performed for a plurality of covering layers by using one electrode.

When a plurality of electrodes 6 are electrically connected, this disclosure is further effective. When the plurality of electrodes 6 are electrically connected, the degree of kogation removal performance varies between the electrodes 6 due to a voltage drop. In other words, a voltage drop is small on electrodes located close to the entry of wiring, and if the removal of kogation is performed by using those electrodes, removal of the kogation can proceed easily. In contrast, a voltage drop is large on electrodes located far from the entry of wiring, and if the removal of kogation is performed by using those electrodes, removal of the kogation cannot proceed easily. In contrast, with the configuration of removing kogation via the supply ports as in this disclosure, the difference in degree of kogation removal performance can be reduced.

The electrodes are arranged in a row along an array direction. At this time, the electrode and the covering layer to which the voltage is to be applied for removing kogation may be arranged in different liquid chambers arranged in the same row, or may be arranged in different liquid chambers arranged in different rows.

Second Embodiment

A second embodiment will be described with reference to FIGS. 5A and 5B. Description of the same portions as those of the first embodiment is omitted.

Figure 5A:
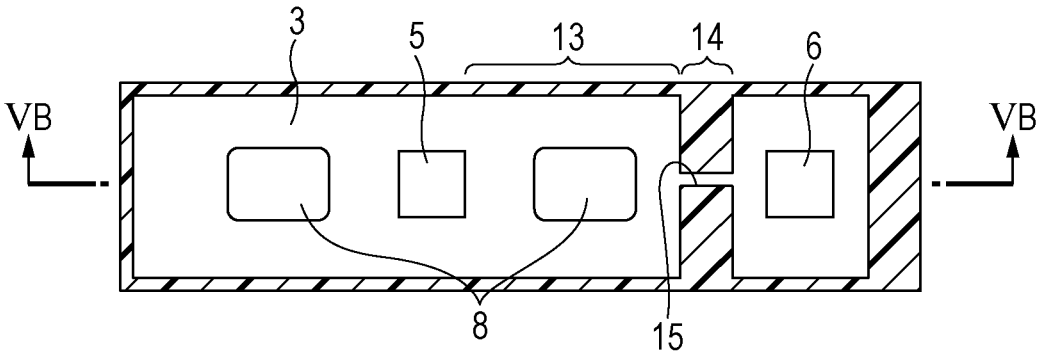
FIGS. 5A and 5B are drawings illustrating the liquid discharge head.

FIG. 5A is a drawing of the liquid discharge head viewed from above. FIG. 5B is a cross-sectional view taken along the line VB-VB of FIG. 5A. In a liquid discharge head illustrated in FIGS. 5A and 5B, the covering layer 5 and the electrode 6 to which a voltage is to be applied to remove kogation are provided in the same liquid chamber. The liquid discharge head of the second embodiment is characterized in that a cross-sectional area of the liquid chamber in a direction from the covering layer 5 toward the electrode 6 (the left and right direction in FIGS. 5A and 5B) includes a relatively-wide portion 13 where a cross-sectional area is relatively wide and a relatively-narrow portion 14 where the cross-sectional area is relatively narrow. The relatively-narrow portion 14 includes a depression 15 in the liquid chamber. In this manner, by forming the depression 15, resistance between the covering layer 5 and the electrode 6 is increased. Therefore, variations in dissolution of the covering layer 5 may be suppressed. The cross-sectional area of the liquid chamber is a cross-sectional area of a portion from the front surface of the substrate 1 to a surface of the liquid chamber forming member 4 on a liquid chamber side (portion indicated by A in FIG. 5B). The cross-sectional area of the liquid chamber does not include, for example, the independent supply port 8 and is a cross-sectional area of a portion of the liquid chamber 3 extending in a direction perpendicular to the front surface of the substrate 1.

The ratio of the cross-sectional area of the relatively-narrow portion 14 where the cross-sectional area is relatively narrow to that of the relatively-wide portion 13 where the cross-sectional area is relatively wide falls preferably within a range from 2% to 70%. If the ratio is lower than 2%, the electrochemical reaction may not be performed desirably. If the ratio exceeds 70%, there is a case where the effect of suppressing variations in dissolution of the covering layer 5 by reducing the cross-sectional area is lowered. More preferably, the ratio is 3% or higher. More preferably, the ratio is 50% or lower and, further preferably, 30% or lower.

Figure 5B:
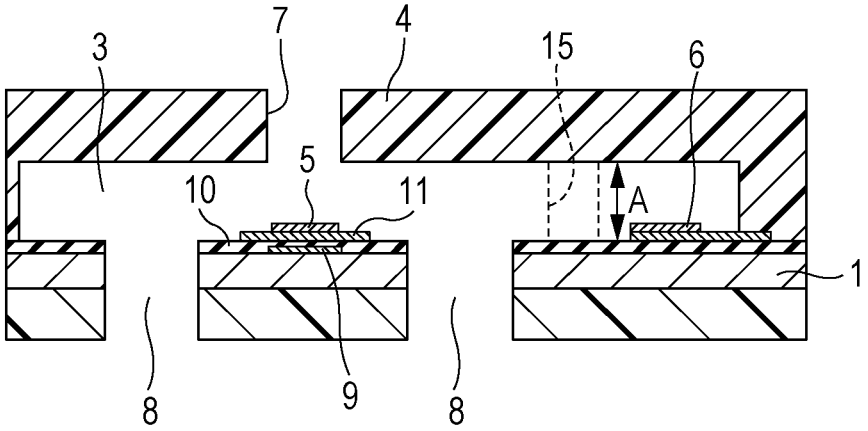
Figure 6A:
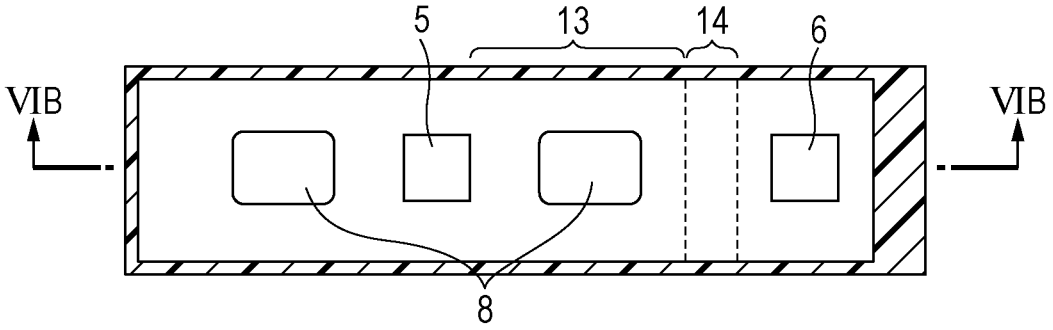
FIGS. 6A and 6B are drawings illustrating the liquid discharge head.
Figure 6B:
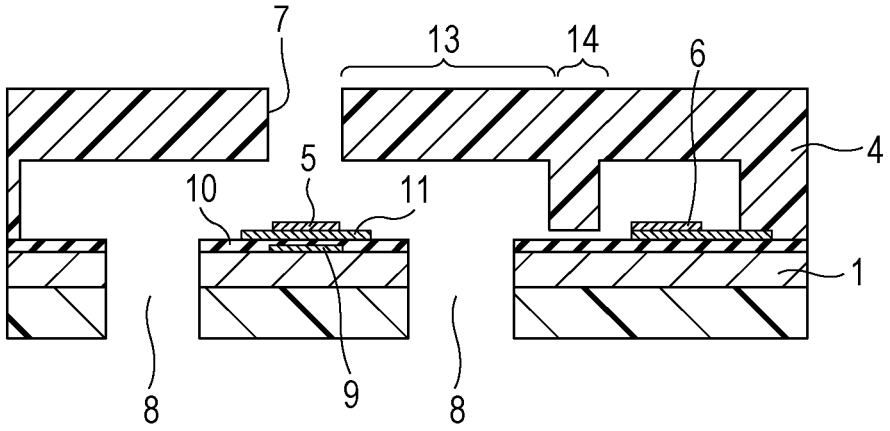

In FIGS. 5A and 5B, the portion narrowed in cross-sectional area when the liquid discharge head is viewed from above is formed. However, as illustrated in FIGS. 6A and 6B, the portion narrowed in cross-sectional area in the cross-sectional view of the liquid discharge head may be formed. FIG. 6B is a cross-sectional view taken along the line VIB-VIB of FIG. 6A. As illustrated in FIGS. 6A and 6B, the relatively-wide portion 13 and the relatively-narrow portion 14 in cross-sectional area of the liquid chamber in the direction from the covering layer 5 toward the electrode 6 exist in the liquid chamber. In FIGS. 6A and 6B, a projection extends downward from the liquid chamber forming member 4, whereby the relatively-narrow portion 14 is formed.

Figure 7A:
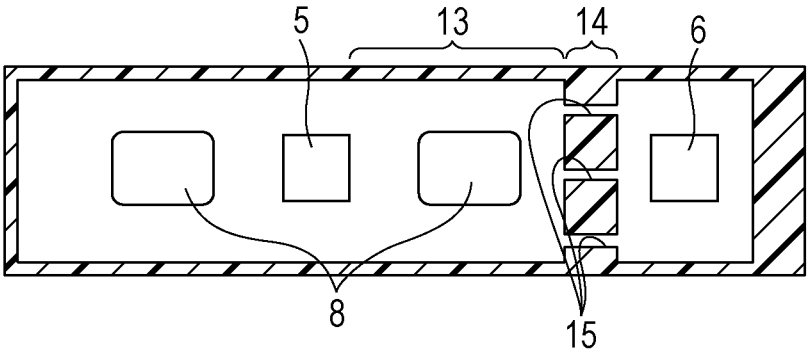
FIGS. 7A to 7C are drawings illustrating the liquid discharge head.

As illustrated in FIG. 7A, a plurality of relatively-narrow portions 14 in cross-sectional area can be provided for the relatively-wide portion 13 in cross section. In this configuration, even if bubbles generated in the liquid chamber enter a depression 15, the route can be secured via other depressions 5. Therefore, the electrochemical reaction is desirably achieved.

Figure 7B:
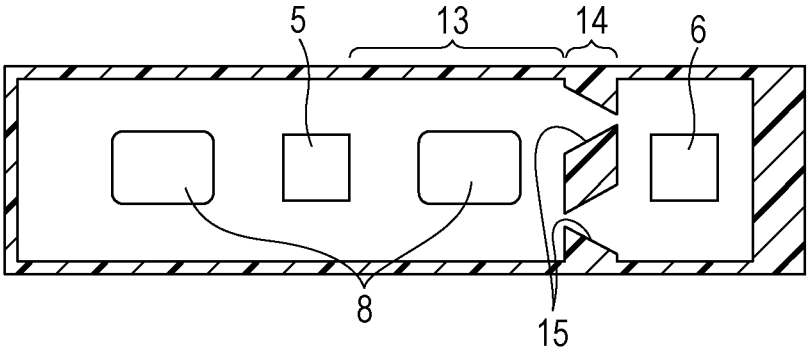
Figure 7C:
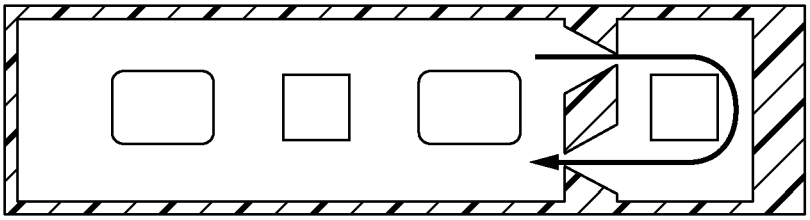

In addition, in the case where the filling property of initially filling the liquid chamber with liquid is required, a mode illustrated in FIGS. 7B and 7C can be employed. That is, as illustrated in FIG. 7B, the cross-sectional area of the relatively-narrow portion 14 decreases along a direction from the covering layer 5 toward the electrode 6. In this configuration, a flow of liquid as illustrated in FIG. 7C is expected, and the initial filling property can be improved while suppressing retention of air bubbles in the depressions 15 and while maintaining electric resistance.

EXAMPLES

Example 1

In Example 1, the liquid discharge head having the shape as illustrated in FIGS. 2A to 2C was used. The substrate 1 was formed of silicon and was provided with a thermal storage layer (not illustrated) formed of $SiO_2$ on an upper surface thereof. The thickness of the thermal storage layer was 1.7 μm. A layer of the heat-generating resistor formed of TaSiN was provided on the surface of the substrate 1, and a lower portion of the covering layer 5 formed of Ir was the heat-generating resistor 9. The heat-generating resistor 9 had a 15 μm×15 μm square when viewed from a position opposing the surface of the substrate. The insulation layer 10 formed of SiN having a thickness of 0.2 μm was provided on the heat-generating resistor 9, and the adhesion layer 11 having a thickness of 0.1 μm formed of Ta was provided thereon. The covering layer 5 was formed of Ir, and had a thickness of 0.1 μm. The covering layer 5 was a 20 μm×20 μm square when viewed from the position opposing the surface of the substrate. The electrode 6 was also formed of Ir and had a thickness of 0.1 μm, and was provided on the insulation layer 10 formed of SiN and the adhesion layer 11 formed of Ta. The adhesion layer 11 was a 20 μm×20 μm square when viewed from the position opposing the surface of the substrate. The liquid chamber forming member 4 forming the liquid chamber 3 was formed by curing an epoxy resin, and the liquid chamber forming member 4 was provided with the discharge port 7 opened therethrough. The liquid chamber 3 was filled with pigments ink (BCI-3eBk manufactured by Canon).

A cleaning process for removing kogation was performed on the liquid discharge head as described above. Specifically, a voltage of 5 V was applied between the electrode 6 illustrated at a left end of FIG. 2B and the covering layer 5 illustrated in FIG. 2C for 600 seconds. In FIGS. 2B and 2C, a=20 μm, b=725 μm, and c=423 μm were established. In other words, a minimum distance between the electrode 6 illustrated at the left end of FIG. 2B and the covering layer 5 illustrated in FIG. 2C via liquid was a+b+c+b+a=1913 μm. In this manner, a cleaning process for removing kogation was performed.

Example 2

With the liquid discharge head of Example 1, removal of kogation was performed for a liquid chamber located at the same position in a next row of the liquid chamber where the removal of kogation was performed in Example 1. The minimum distance via the liquid between the electrode 6 and the covering layer subjected to the kogation removal was 2336 μm. A cleaning process for removing kogation was performed in the same manner as Example 1 except for the minimum distance. A configuration and so on in the liquid chamber were the same as Example 1.

Example 3

In Example 3, the liquid discharge head having the shape as illustrated in FIGS. 4A and 4B was used. The materials, the thicknesses, and the like of the respective portions were the same as those in Example 1.

A cleaning process for removing kogation was performed on the liquid discharge head as described above. Specifically, a voltage of 5 V was applied between the covering layer 5 in the liquid chamber 3*e* of FIG. 4B and the electrode 6 in the liquid chamber 3*g* for 600 seconds. In FIG. 4B, a=56 μm, b=1025 μm, c=3423 μm, and d=10 μm were established. In other words, a minimum distance via the liquid between the covering layer 5 in the liquid chamber 3*e* and the electrode 6 in the liquid chamber 3*g* was a+b+c+b+d=5539 μm.

Example 4

By using the liquid discharge head illustrated in FIGS. 5A and 5B, the cleaning process for removing kogation was performed in the same manner as Example 1. However, the covering layer 5 and the electrode 6 were provided in the same liquid chamber, and the cross-sectional area of the liquid chamber from the covering layer 5 toward the electrode 6 has the relatively-wide portion 13 and the relatively-narrow portion 14. The width of the liquid chamber (the vertical direction of FIG. 5A) was 60 μm, the height of the liquid chamber was 14 μm, and the width of the depression 15 (the vertical direction of FIG. 5A) was 5 μm. The distance between the covering layer 5 and the electrode 6 was 80 μm and the length of the depression 15 was 20 μm. The cleaning process for removing kogation was performed in the same manner as Example 1 except for those described above.

Comparative Example

The cleaning process for removing kogation was performed on the same liquid discharge head as the liquid discharge head used in Example 3. However, the voltage of 5 V was applied between the covering layer 5 and the electrode 6 in the liquid chamber 3*e* for 600 seconds to dissolve the covering layer 5 in the liquid chamber 3*e*. The covering layer 5 and the electrode 6 in the liquid chamber 3*e* were in the same liquid chamber and were formed on the same plane, and the minimum distance therebetween via the liquid was a=56 μm.

Comparison of Amounts of Dissolution of Covering Layer 5

A difference in thickness (amount of reduction) and the state of the covering layers 5 before and after application of the voltage, on which the kogation removal was performed, of the liquid discharge heads after the application of a voltage were measured by using a microscope. In other words, a change of the thickness and a state of one of the covering layers 5 that covers one heat-generating resistor was measured.

According to the results, in the liquid discharge head of Example 1, a reduction in thickness of the covering layer was substantially uniform in the covering layer. The thickness of the covering layer was reduced by approximately 8 nm. In the liquid discharge head of Example 2 as well, a reduction in thickness of the covering layer was substantially uniform in the covering layer, and the thickness of the covering layer was reduced by approximately 7 nm.

In the liquid discharge head of Example 3, a reduction in thickness of the covering layer was more uniform in the covering layer in comparison with Example 2. The thickness of the covering layer was reduced by approximately 5 nm.

In the liquid discharge head of Example 4, a reduction in thickness of the covering layer was substantially uniform in the covering layer, and the thickness of the covering layer was reduced by approximately 7 nm.

In the liquid discharge head of Comparative Example 1, a reduction in thickness of the covering layer varied in the covering layer, a reduction in thickness in an area near the electrode 6 was large and a reduction in thickness in an area far from the electrode 6 was small. The thickness of the covering layer was reduced by 40 nm at an end near the electrode 6, and 26 nm at an end far from the electrode 6.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-138879, filed Jul. 4, 2014, and Japanese Application No. 2015-080456, filed Apr. 9, 2015, which are hereby incorporated by reference herein in their entirety.

What is claimed is:

1. A method of cleaning a liquid discharge head, the method comprising:

presenting the liquid discharge head having a liquid chamber forming member configured to form a first liquid chamber and a second liquid chamber, a substrate provided with a heat-generating resistor covered with a covering layer provided in the first liquid chamber, and an electrode provided in the second liquid chamber; and applying a voltage between the covering layer and the electrode in case that the covering layer and the electrode communicate with each other through liquid to cause an electrochemical reaction between the covering layer and the liquid and dissolve the covering layer into the liquid to remove kogation accumulated on the covering layer.

2. The method according to claim 1, wherein presenting the liquid discharge head includes presenting the liquid discharge head having the substrate provided with a supply port penetrating the substrate, and wherein applying the voltage includes applying the voltage in case that the covering layer and the electrode communicate with each other through the liquid via the supply port.

3. The method according to claim 1, wherein the covering layer is located at a distance of at least 60 μm from the electrode.

4. The method according to claim 1, wherein the covering layer is located at a distance of at least 150 μm from the electrode.

5. The method according to claim 1, wherein the covering layer is located at a distance of not more than 6000 μm from the electrode.

6. The method according to claim 1, wherein the covering layer is located at a distance of not more than 2000 μm from the electrode.

7. The method according to claim 1, wherein presenting the liquid discharge head includes presenting the liquid discharge head having another electrode that is different from the electrode and that is provided in the first liquid chamber, and wherein applying the voltage includes not applying voltage between the covering layer and the another electrode.

8. The method according to claim 1, wherein presenting the liquid discharge head includes presenting the liquid discharge head having a supporting member that supports the substrate and includes a flow channel, and wherein applying the voltage includes applying the voltage between the covering layer and the electrode through the liquid via the flow channel.

9. The method according to claim 1, wherein a heat-generating resistor is not arranged in the second liquid chamber.

10. The method according to claim 1, wherein presenting the liquid discharge head includes presenting the liquid discharge head having the substrate provided with a plurality of the heat-generating resistors, each covered with a different one of a plurality of the covering layers that are provided in the first liquid chamber, and wherein applying the voltage includes applying the voltage between the plurality of covering layers and the electrode.

11. The method according to claim 1, wherein presenting the liquid discharge head includes presenting the liquid discharge head such that the covering layer is formed of iridium (Ir) or ruthenium (Ru).

12. The method according to claim 1, wherein presenting the liquid discharge head includes presenting the liquid discharge head such that the electrode is formed of iridium (Ir) or ruthenium (Ru).

13. The method according to claim 1, wherein presenting the liquid discharge head includes presenting the liquid discharge head such that the covering layer is formed of a material that is the same material that forms the electrode.

14. The method according to claim 1, wherein presenting the liquid discharge head includes presenting the liquid discharge head having the substrate provided with covered with another covering layer and provided in the second liquid chamber, wherein the another heat-generating resistor is different from the heat-generating resistor and the another covering layer is different from the covering layer that is different from the heat-generating resistor covered with another covering layer that is different from the covering layer and that is provided in the second liquid chamber.

* * * * *